United States Patent [19]

Partin et al.

[11] 4,353,453

[45] Oct. 12, 1982

[54] VALID COIN ACCEPTOR FOR COIN ACTUATED APPARATUS

[75] Inventors: Norman D. Partin, Henderson, Nev.; Charles L. Watson, Phoenix, Ariz.

[73] Assignee: ATN Research & Development Corporation, Henderson, Nev.

[21] Appl. No.: 138,996

[22] Filed: Apr. 10, 1980

[51] Int. Cl.[3] ..... G07F 3/02

[52] U.S. Cl. ..... 194/100 A; 73/163

[58] Field of Search ..... 194/97 R, 100 R, 100 A, 194/99, 102; 73/163; 209/567, 571; 324/233, 234, 236, 239, 243

[56] References Cited

U.S. PATENT DOCUMENTS

| | | | |
|---|---|---|---|
| 3,576,244 | 4/1971 | Ptacek et al. | 194/100 A |
| 3,682,286 | 8/1972 | Prumm | 194/100 A |
| 3,749,220 | 7/1973 | Tabiichi et al. | 194/100 A |
| 3,758,849 | 9/1973 | Susman et al. | 324/243 X |
| 3,952,851 | 4/1976 | Fougere et al. | 194/100 A |
| 4,108,296 | 8/1978 | Hayashi et al. | 194/100 A X |
| 4,226,323 | 10/1980 | Dautremont | 194/100 A |

FOREIGN PATENT DOCUMENTS

| | | | |
|---|---|---|---|
| 2213403 | 10/1973 | Fed. Rep. of Germany | 194/100 A |

*Primary Examiner*—Edward M. Wacyra
*Attorney, Agent, or Firm*—Wagner & Bachand

[57] ABSTRACT

An improved coin acceptor mechanism employing an oscillator and a resonant circuit for detecting the electromagnetic effect of valid and invalid coins passing through a coil of the tuned circuit. A particular linear coil configuration provides a unique signature for each coin including at least one maximum and one minimum amplitude level of resonant circuit current. A comparator establishes at least two electrical signal amplitude windows representative of each valid coin signature. A logic circuit responds only to the coin falling within the two electrical signal amplitude windows for actuation. A novel coil design and assembly are enclosed.

19 Claims, 33 Drawing Figures

FIG. 1
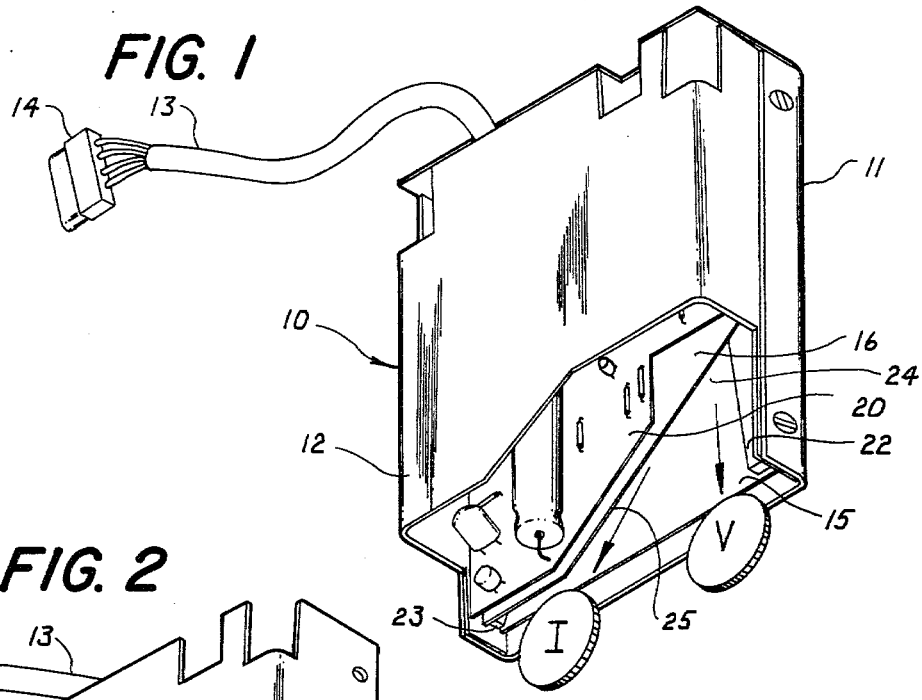
FIG. 2
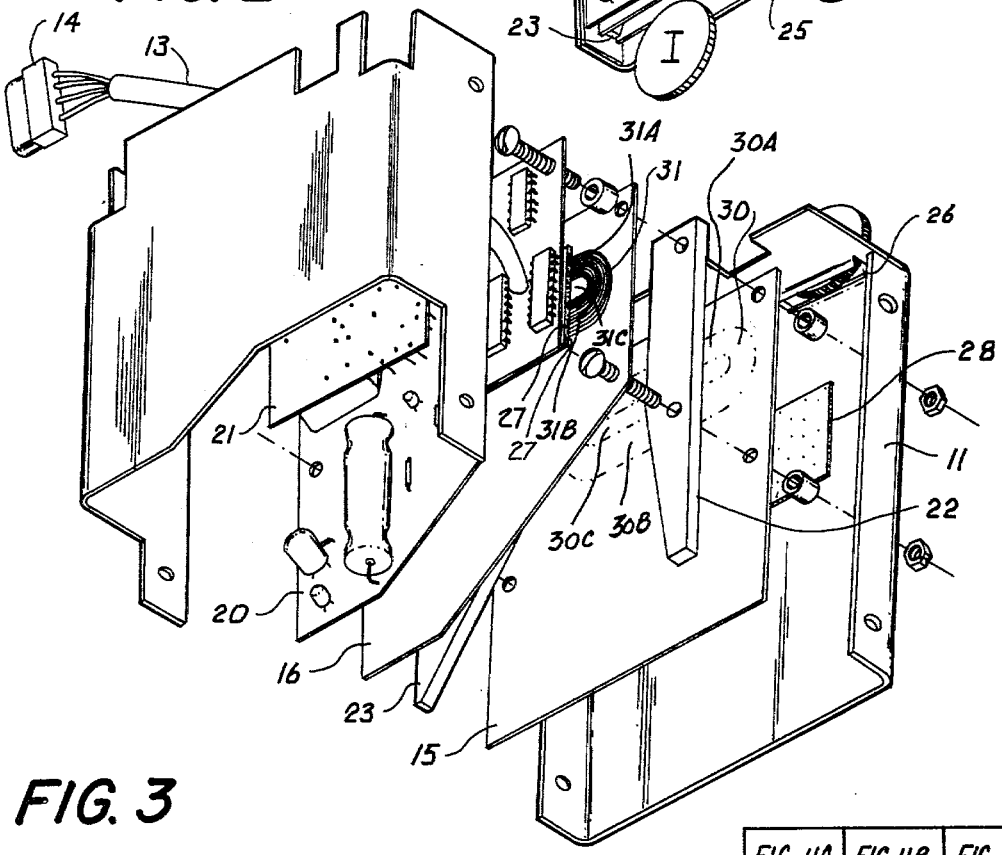
FIG. 3
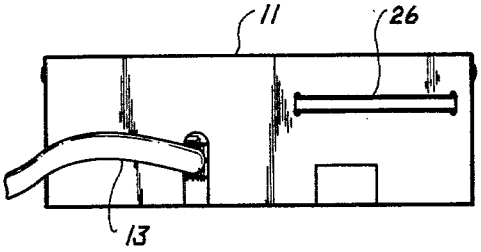
FIG. 4
| | | | |
|---|---|---|---|
| FIG. 11A | FIG. 11B | FIG. 11C | FIG. 11D |
| | FIG. 11E | FIG. 11F | FIG. 11G |

VALID COIN ACCEPTOR FOR COIN ACTUATED APPARATUS

BACKGROUND OF THE INVENTION

Coin acceptors for coin actuated machines have developed into a refined art. In the past mechanical mechanisms have performed as many as seven tests on a coin while it passes through an acceptor mechanism including measuring its weight, diameter, resiliency, thickness, magnetic properties and freedom from a central hole.

More recently electromagnetic testing of coins has to a large degree supplanted mechanical testing in electrically powered machines. We have found however that the best electromagnetic testing acceptors still reject valid but worn coins and accept invalid coins to an unacceptable level.

Typical electromagnetic testers employ an oscillator and a resonant circuit including a single or double coil placed near a coin passage. The circuit detects a change in frequency in the resonant circuit resulting from the passage of a coin or other ferromagnetic material through the coin passage. Certain such systems detect the amplitude change of current in the resonant circuit. Typical prior art systems are disclosed in the following patents:

| | |
|---|---|
| 3,317,016 | Frequency shift detected |
| 3,939,953 | Vibrates coin |
| 3,741,363 | uses 3 coils and a standard coin |
| 2,642,974 | coin passes through a coil |
| 3,901,368 | dual printed circuit type coils |
| 3,870,137 | dual frequency system |
| 4,105,105 | single acceptance window |
| 4,108,105 | single acceptance window for each coin. |

Given these refinements, we have found that prior art systems still lack sufficient reliability. Moreover many require modification of or redesign of the coin actuated apparatus to accommodate the coin acceptor.

BRIEF DESCRIPTION OF THE INVENTION

We have discovered that it is possible employing a pair of coils of improved configuration to define more than one acceptance window for each coin to be accepted and in doing so to improve the reliability in both accepting valid coins and rejecting invalid ones. We have also discovered that it is possible to integrate our improved reliability device into a package directly interchangeable with prior art acceptors for electrically operated coin machines without change. A vertical coin passage is possible with our invention for minimum coin transit time and to minimize multiple coin blockage.

Our coils which embrace the coin passage include linear sections in the coin passage region whereby the coin couples with two distinct linear coil regions and produces a unique amplitude signature for that type of coin. The signature includes at least one maximum and one minimum amplitude level each of which must fall within acceptance levels.

Logic circuitry responds to the required sequence of maximum and minimum levels to energize the coin mechanics acceptance solenoid. A counter is used to record the sequence and any deviation in amplitude resets the counter, barring coin acceptance.

BRIEF DESCRIPTION OF THE DRAWING

This invention may be more clearly understood from the following detailed description and by reference to the drawing:

FIG. 1 is a perspective view of a physical embodiment of this invention;

FIG. 2 is an exploded view thereof;

FIG. 3 is a top view thereof;

FIG. 4 is a layout drawing for the schematic diagram FIGS. 11A–11G of this invention;

FIGS. 8A–10F are graphical presentations representing the operation of this invention;

DETAILED DESCRIPTION OF THE INVENTION

Figure 5:
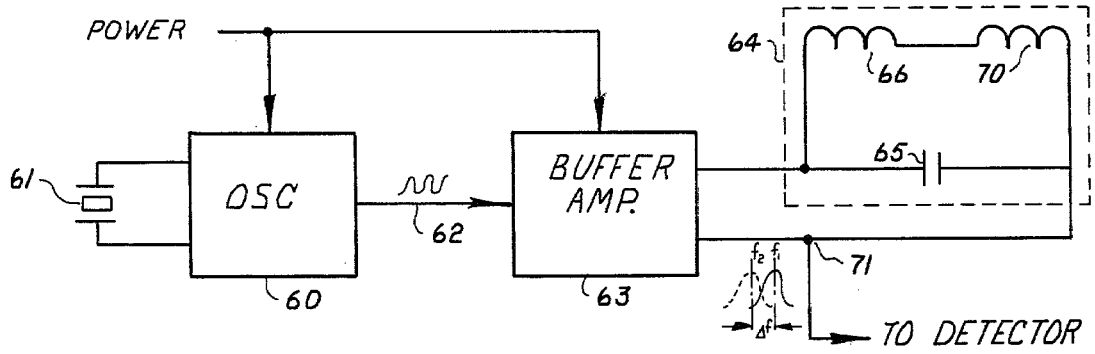
FIG. 5 is a generalized block diagram of this type of coin acceptor.

The need for a more effective coin acceptor for coin operated devices has been great as indicated above. This need also encompasses a requirement that an improved coin acceptor avoid the need of redesign of the hundreds of thousands of present, efficient and operating coin actuated vending machines. It is essential that such an improved coin acceptor be plug compatible with existing coin rejection devices such that the existing mechanical or electro mechanical device may be removed and directly replaced by improved coin acceptor. Therefore our invention involves not only the development of the improved concept in circuitry for providing a higher degree of acceptance of valid coins plus a rejection of spurious or damaged coins.

Our concept involves such a plug-in equivalent device which is shown in FIGS. 1, 2 and 3. Our coin acceptor generally designated 10 comprises a rectangle package including a frame or backing plate 11 and a cover plate 12 and extension jacketed four conductor cable 13 and a four terminal plug 14 compatible with common existing coin rejector mechanisms. The package in this preferred embodiment is approximately 3 inches by 2 and $\frac{1}{2}$ inches by 1 inch designed to be located in the recess of coin actuated machines which employ commonly available coin rejectors. The assembly employs four printed circuit board type members including a first coil plate 15, a second coil plate 16, a master assembly circuit board 20, and an oscillator board not shown in FIG. 1 but appearing in FIG. 2 and designated therein as circuit board 21. A number of the electronic components appear in FIG. 1 in a typical installation employing discrete elements.

The coil boards 15 and 16 are separated by spacers 22 and 23 best seen in FIGS. 2 and 3. These spacers and the coil boards 15 and 16 define the coil slot 24 therebetween. The coil slot 24 is partially open at its front side by reason of the angular cut off side 25 of the coil board 16 in order to accommodate a coin gate which extends into the coil slot 24. The function of the coin gate is the same as in the case of mechanical or electromechanical slug rejectors, namely to block the entrance of spurious coins into the coin box and to discharge such invalid coins via a discharge chute. The path of valid coins is indicated by the two coins marked V and the discharge path of an invalid coin is marked I.

Now referring specifically to FIG. 2 showing significantly more details of the coin acceptor of this invention one may see that a coin entrance opening 26 appears in the top of the assembly aligned with the normal path of the coin to the coin gate controlled by solenoid unshown in the drawing inasmuch as it is incorporated in the vending machine apparatus apart from the coin acceptance or slug rejection assembly.

The coin traverses the route through the coin acceptor 10 via the elongated slot 24 to the discharge opening and in doing so passes between a pair of planar coil sections 30 and 31 which preferably are produced employing printed circuit techniques on the outer faces of the coil plates 15 and 16. The spacer-guides 22 and 23 provide sufficient thickness between the two coil sections 30 and 31 to allow any coin of the appropriate thickness to pass therebetween and to change electromagnetic coupling between the two coils 30 and 31.

Figure 7A:
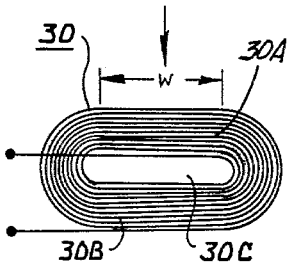
FIGS. 7A–7D is a schematic diagram of a coin passing through this invention.
Figure 7B:
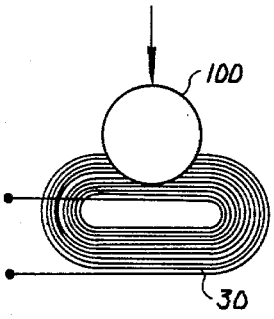
Figure 7C:
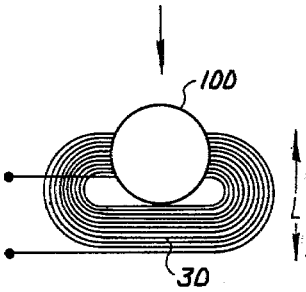
Figure 7D:
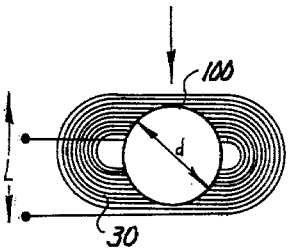

It must be noted that the coils 30 and 31 are elongated and extending broader than the coin path 24 and in particular have two generally linear planar sections, the function of which is described below. A coin traversing the coin path 24 will pass through a region of close coupling with the upper or linear sections 30A and 31A of the respective coils 30 and 31 and will subsequently pass by the lower linear sections 30B and 31B respectively. This passage arrangement is more clearly shown in FIG. 7 in which the linear sections 30A and 30B appear in sequential locations as a coin travels through the coin path indicated by the arrow in FIG. 7A. The turns are connected in series in the preferred embodiment, however they may be tapped for use of different sized coins or may include parallel sections if it is so desired.

Another feature of this invention is visible in FIG. 2. Overlying each coil 30 and 31 are respective magnetic shields 28 and 27 made up preferbly of magnetic rubber tape which is bonded to the coils. We have found that metal shields do cut down stray fields affecting the operation but they also tend to reduce the field strength in the coin passage. The use of magnetic rubber, permanent magnet particles embedded in rubber served to retain the field in the coin passage and make the effect of coin passage more pronounced and more repeatable. Any attempt to defeat the coin acceptor by magnetic means is thwarted by this magnetic shield.

Again referring to FIG. 2 in conjunction with FIG. 7 it is apparent that there is an open section 30C and 31C which constitute a significant percentage of the coin diameter measured in the direction of travel. The importance of the configuration of the coil is further described below in connection with the operation of this invention.

Suffice it to say, FIGS. 1, 2 and 3 show a coin acceptor mechanism with a coin slot therethrough and coil means embracing the coin path and the necessary electronic circuitry to process the required signal resultant from the coin passage and to determine whether the coin is a valid or invalid.

The basic principle of operation of electromagnetic slug rejectors of the type including this invention is illustrated in FIG. 5 in which an oscillator 60 preferably controlled by crystal 61 provides a fixed frequency output on lead 62 which in turn is amplified in buffer amplifier 63 to which a resonant circuit 64 is coupled. The resonant circuit 64 comprises a capacitor 65 and a coil made up of a pair of sets of turns 66 and 70 connected preferably in series. The resonant circuit 64 normally has a natural resonant frequency F1 significantly lower than that of the crystal 61 and provides a conventional bell shaped response curve centered on the frequency F1 in the absence of any perturbations in the electromagnetic field encompassed by the coils or surrounding the coils. The output of the resonant circuit 64 may be taken at terminal 71 and introduced into a detector. If ferromagnetic or even nonmagnetic but conductive materials are introduced into the field of the coil 66 and 70 the characteristic output curve is changed in particular by a shift of the bell shape curve from the frequency F1 to a different frequency shown in FIG. 5 as F2. Typical prior art systems look for the frequency shift Delta F and make the determination in the detector as shown in FIG. 5 whether a coin is valid or invalid depending upon the value of Delta F.

We have found that while a coin detector based upon the principle and system of FIG. 5 in theory is operative it is not useful per se in that it lacks the necessary slug rejecting capability and also tends to reject good but worn coins to the frustration of the vending machine operator in the first case or the patron in the second case.

Figure 6:
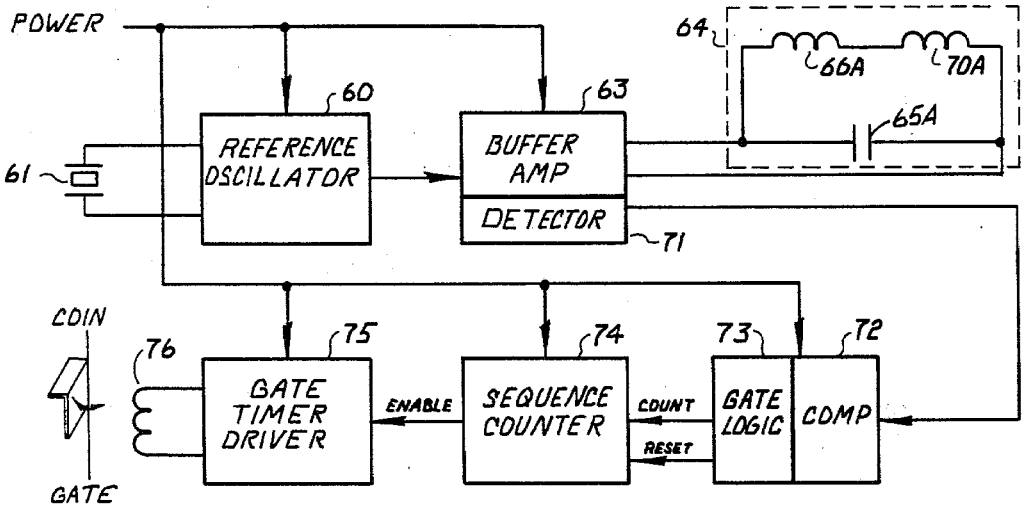
FIG. 6 is a block diagram of this invention.

Our invention is illustrated in FIG. 6 in which identical referenced numerals are employed where appropriate to show the similarity where similarity exists. Again a crystal controlled oscillator 60, buffer amplifier 63 and a resonant circuit 64 made up of a pair of turns 66A and 70A and a capacitor 65A are used. A detector 71 is for purpose of convenience incorporated in the buffer amplifier module but functionally is as described below. Beyond the detector 71 however a plurality of level discriminators are employed, specifically, four different level discriminators identified as C-1, C-2, C-3, and C-4 are employed. Level detectors C-1 and C-2 define a first amplitude window while C-3 and C-4 define a second amplitude window. The output of the level discriminators and comparators 72 is applied to a sequence counter 74 capable of counting a plurality of sequences the preferred number being three. The sequence counter 74 may be a simple three stage counter with a reset input. The sequence counter is operative when a count of three is reached to provide an enabling pulse to a gate timer driver 75 which operates the solenoid 76 of a coin gate positioned in the path of the coin to direct the coin either to the valid coin bin or to the invalid coin discharge slot.

Referring again to FIG. 7 in conjunction with FIG. 6, it may be seen that the coil employed in this invention is not simply a multi-layered coil or even a flat helically wound coil of continuously curve conductors as in the past. Instead the coil is elongated in a direction transverse to the direction of passage of coins and includes a pair of straight sections each having a width W greater than the transverse dimension of the valid coin to be accepted. The coils also include a significant central area free of winding which must be passed by the coin 100 in traveling through the coin passage.

It is apparent by reference to FIGS. 7A, 7B, 7C, and 7D that the coin traverses three distinct regions in passing through the coils. It is also apparent by reference to FIG. 7D, that the length L through which the coin travels is greater than the transverse dimensions d of the coin. The central opening area is approximately 20% of the value d in the optimum coil design as we have found by experimentation. Typical dimensions of the coils 30 and 31 for use with a U.S. quarter or the Susan B. Anthony Dollar to be as follows:

| | |
|---|---|
| Number of series of turns | 2 |
| locations | opposed |
| Number of turns per section | 21 |
| Straight section length W | 1.2 in. |
| Central open area path length l | 0.2 in. |
| Total path length through coil | 1 in. or more |
| Max coin diameter | approx 1 in. |

The same coils may be used with smaller coins but the straight length W and the path length L have been found by us to provide effective and reliable acceptance of valid coins and rejection of invalid ones when the above criteria are met.

Figures 8A, 8B, 8C, 8D:
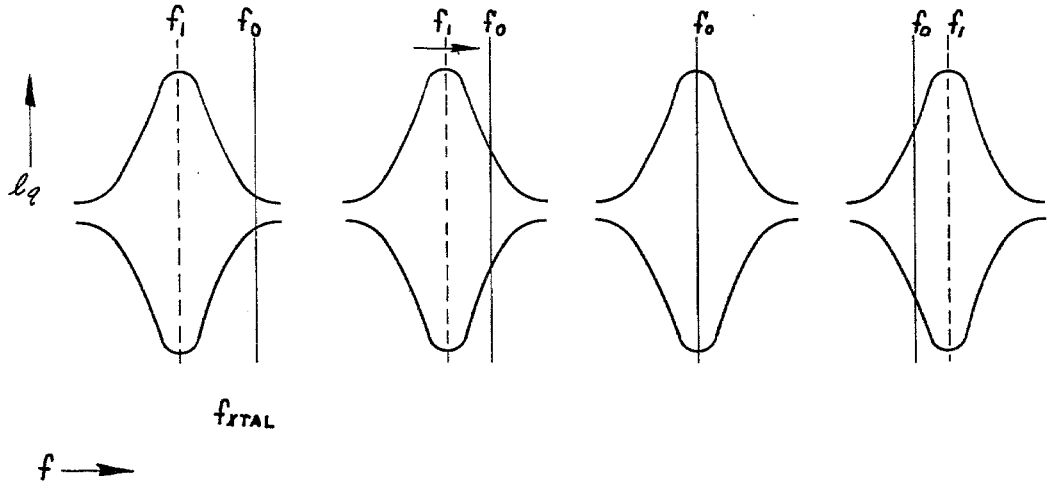

The effect of the passage of a coin through the passage 24 of FIGS. 1 and 2 is shown graphically in FIG. 8 in which the same letters are used to represent set of conditions. As shown in FIG. 8A, the bell shaped curve centered around the frequency f1 is apparent and at a lower frequency than the crystal frequency f0. As the coin 100 of FIG. 7B begins to pass the coil 30 the response curve remains symetrical but tends to move in the direction of the crystal frequency f0 and at some time in its passage corresponding to FIG. 7c the peak will pass through the crystal frequency p0 and at sometime later the peak will move beyond f0 to the right.

Figure 9A:
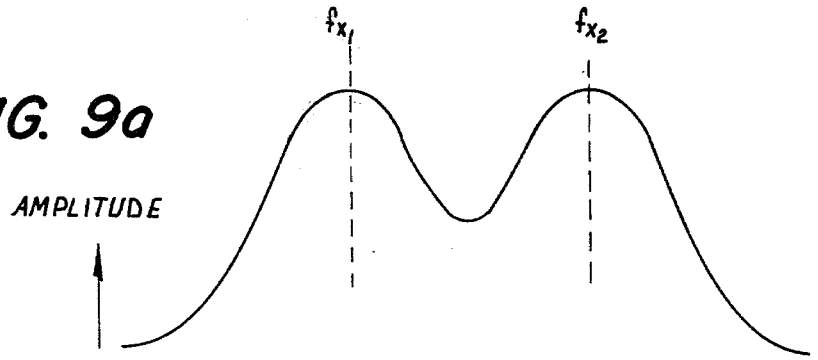

Prior art systems have characteristically employed frequency sensitive networks, filters and the like and have attempted to provide a registration of valid or invalid coins based upon the value of p1. Such systems have characteristically attempted to maintain the coin in a fixed position long enough to establish a value f1. Other prior art systems have employed bridge circuitry employing a "standard" coin as a reference and detected bridge unbalance as an indication of invalid coins. The configuration of the coils disclosed herein, by way of contrast, provides a characteristic response curve as shown in FIG. 9A with two peaks separated by a valley. The frequencies of the peaks fx1 and fx2 are not critical nor are they detected.

Figure 9B:
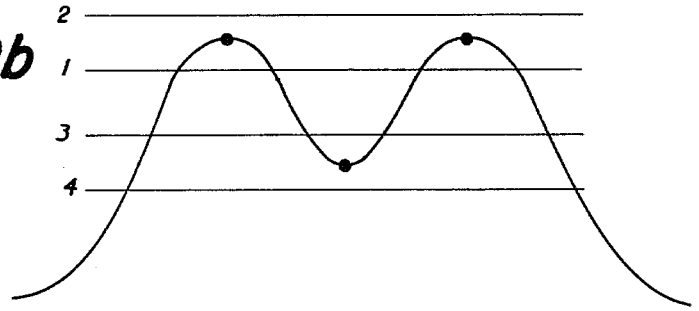
Figure 9C:
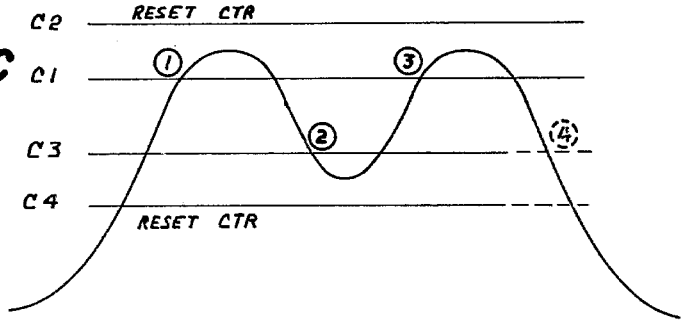

FIG. 9B shows the criteria for selection of a valid coin in accordance with this invention, namely that there be at least one maximum and one minimum as defined by a pair of amplitude windows, 1–2 and 3–4. These amplitude windows are established by amplitude threshold devices which are operative over the frequency range including fx1 and fx2. The use of these amplitude windows is best illustrated in FIG. 9C.

Through the use of four comparators, the correct logic for the evaluation of a valid coin may be carried out. Employing a series of comparators, identified in FIG. 9C as C-1, C-2, C-3 and C-4, the following sequence for a valid coin occurs:

When a coin of the correct electromagnetic properties passes through the coin passage to allow the window 1–2 to be entered, a comparator corresponding to the level C-1 causes the counter to be advanced to a level 1, represented by an encircled 1 in FIG. 9 C.

If the characteristic of the coin matches the characteristic shown sufficiently to drop below the window entrance level C3, the counter is advanced to the count of 2 as represented by the 2 encircled in FIG. 9 C.

Again following the curve further, as the window 1–2 is again entered, the comparator advances the counter to the count of 3. This level of correspondence of the signature of a valid coin, has been found to be sufficient to accept virtually all valid and reject virtually all invalid coins. We have thus determined that using a three stage comparator is sufficient and does not require further qualification of the coin.

Conceivably, and within the scope of this invention, a fourth test could easily be employed and is indicated in the drawing by a dashed circled 4 as the curve again falls below the level 3 into the 3–4 window. The comparators C2 and C4 are similarly connected to the counter, however these comparators are coupled to the reset input of the counter to reset the counter to 0 rather than to advance it.

The effect of the reset capability in the comparator is best illustrated in connection with FIG. 10 showing six typical invalid coin characteristics. By carefully tracing the curves of FIG. 10 using the logic as described in connection with FIG. 9C, one can see that under no circumstances, as illustrated by each of these six varients does the counter reach a count of 3.

Figure 10A:
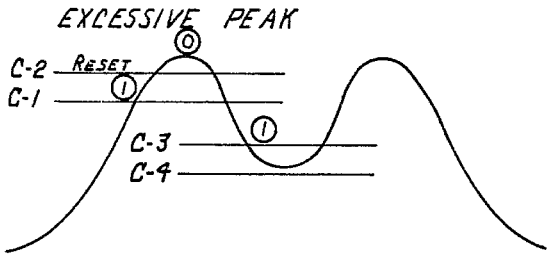
Figure 10B:
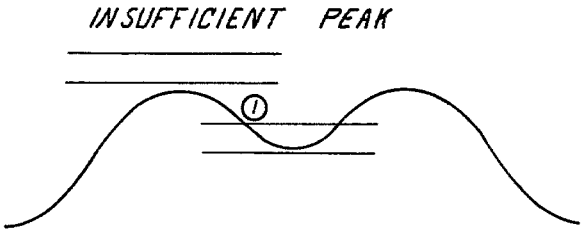
Figure 10C:
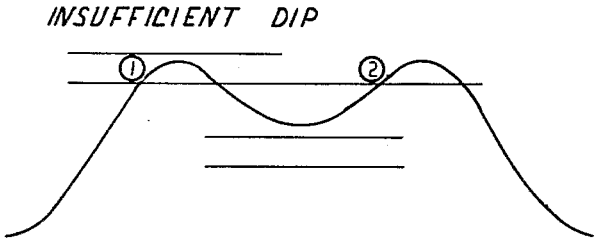
Figure 10D:
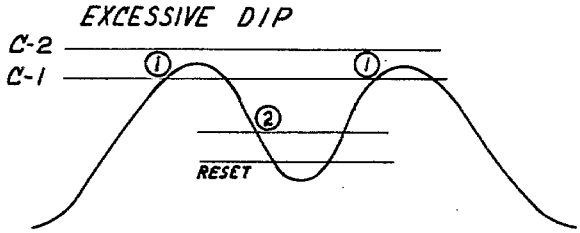
Figure 10E:
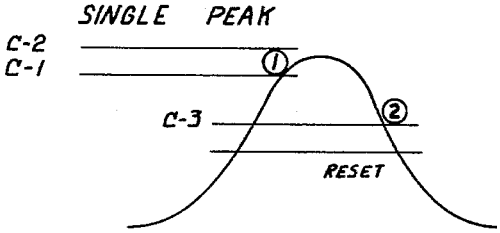
Figure 10F:
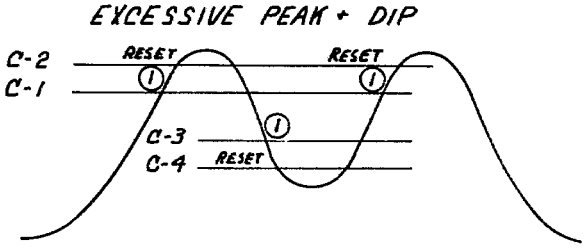
Figure 12:
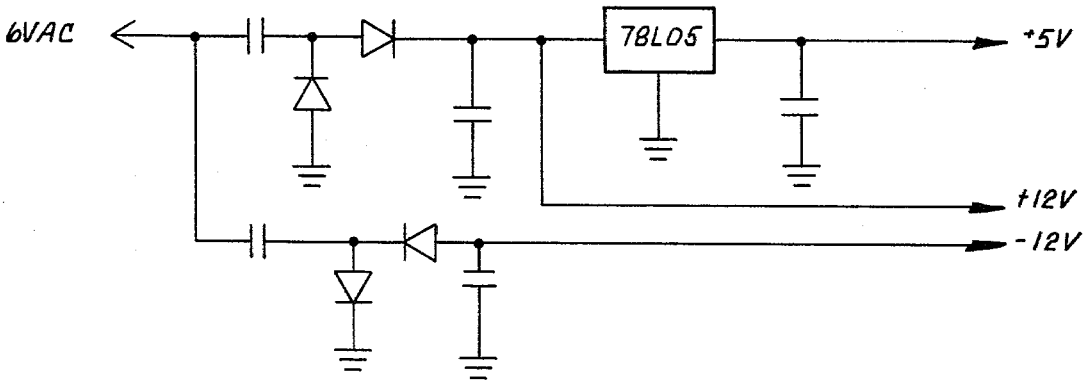
FIG. 12 is an electrical schematic diagram of a power supply therefor.
Figure 11A:
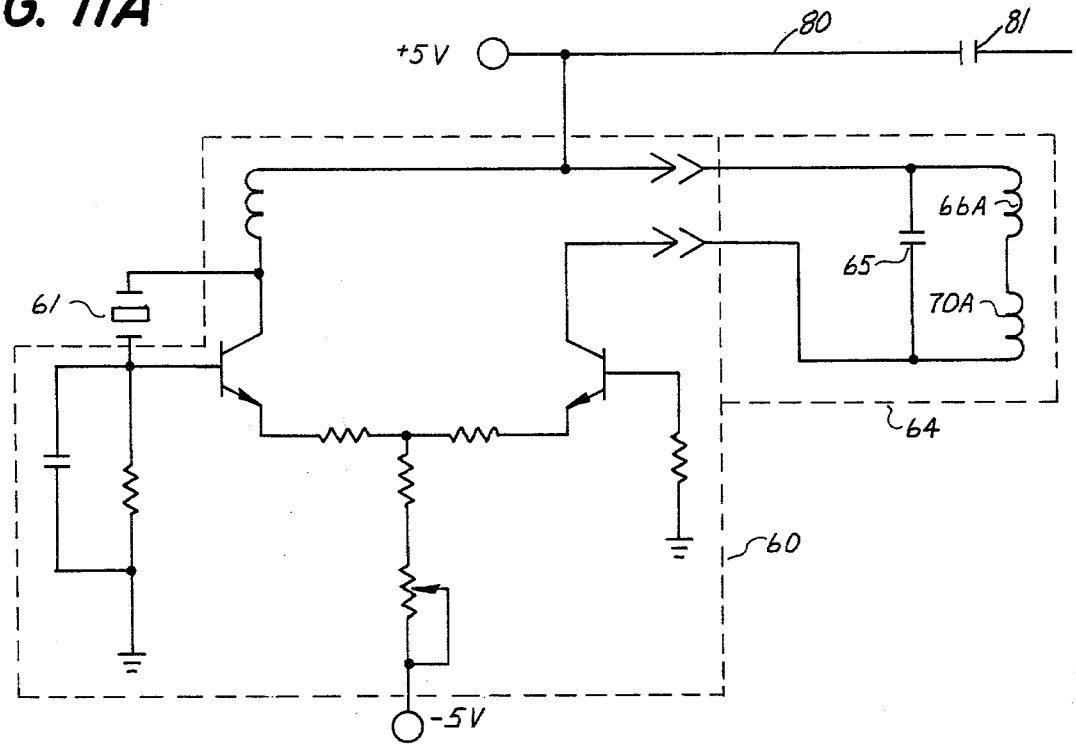
FIGS. 11A–11G is an electrical schematic diagram of this invention.
Figure 11A:
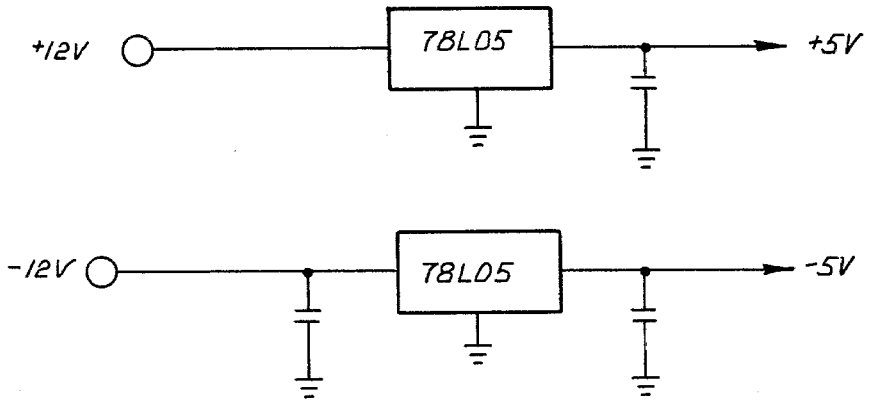
Figure 11B:
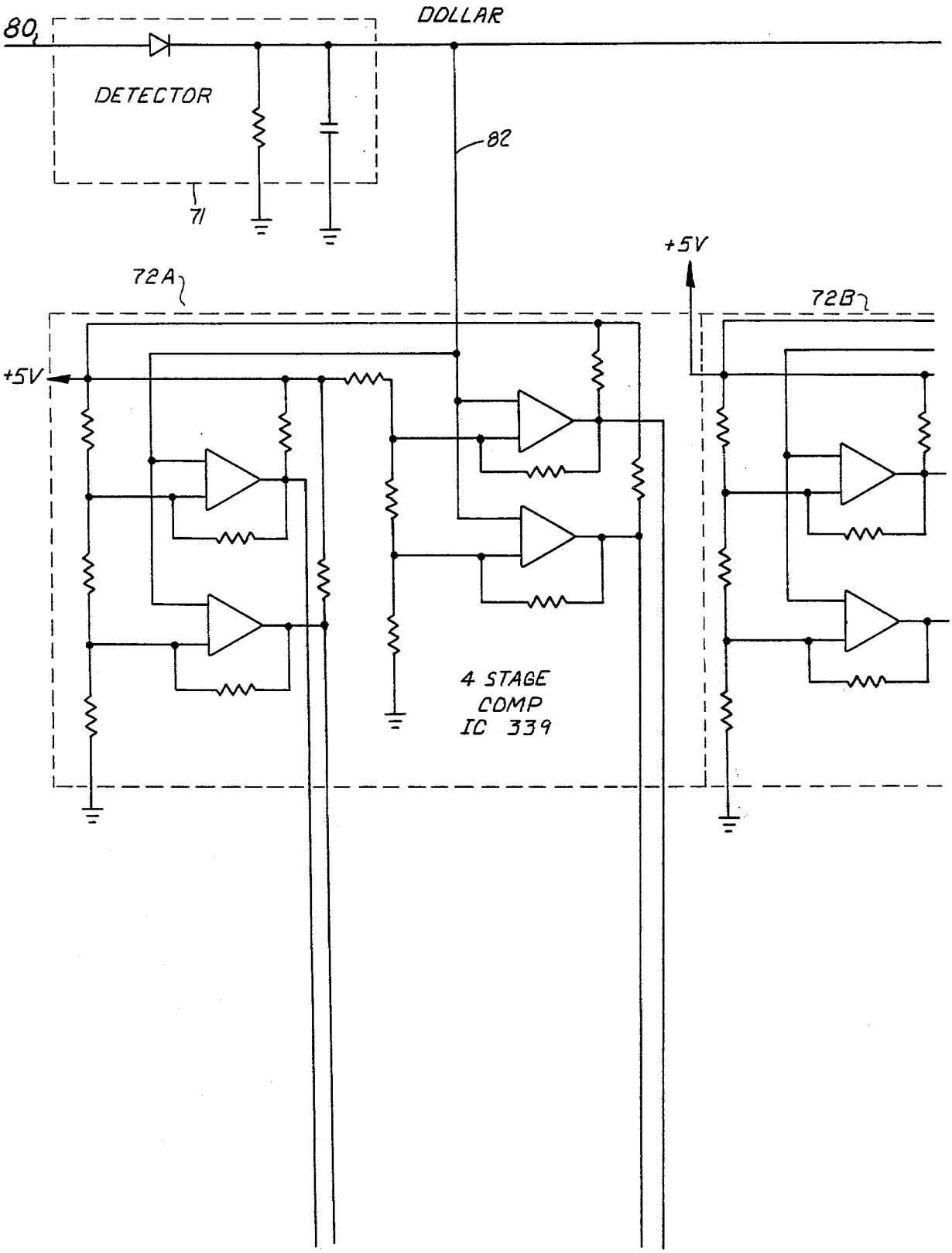
Figure 11C:
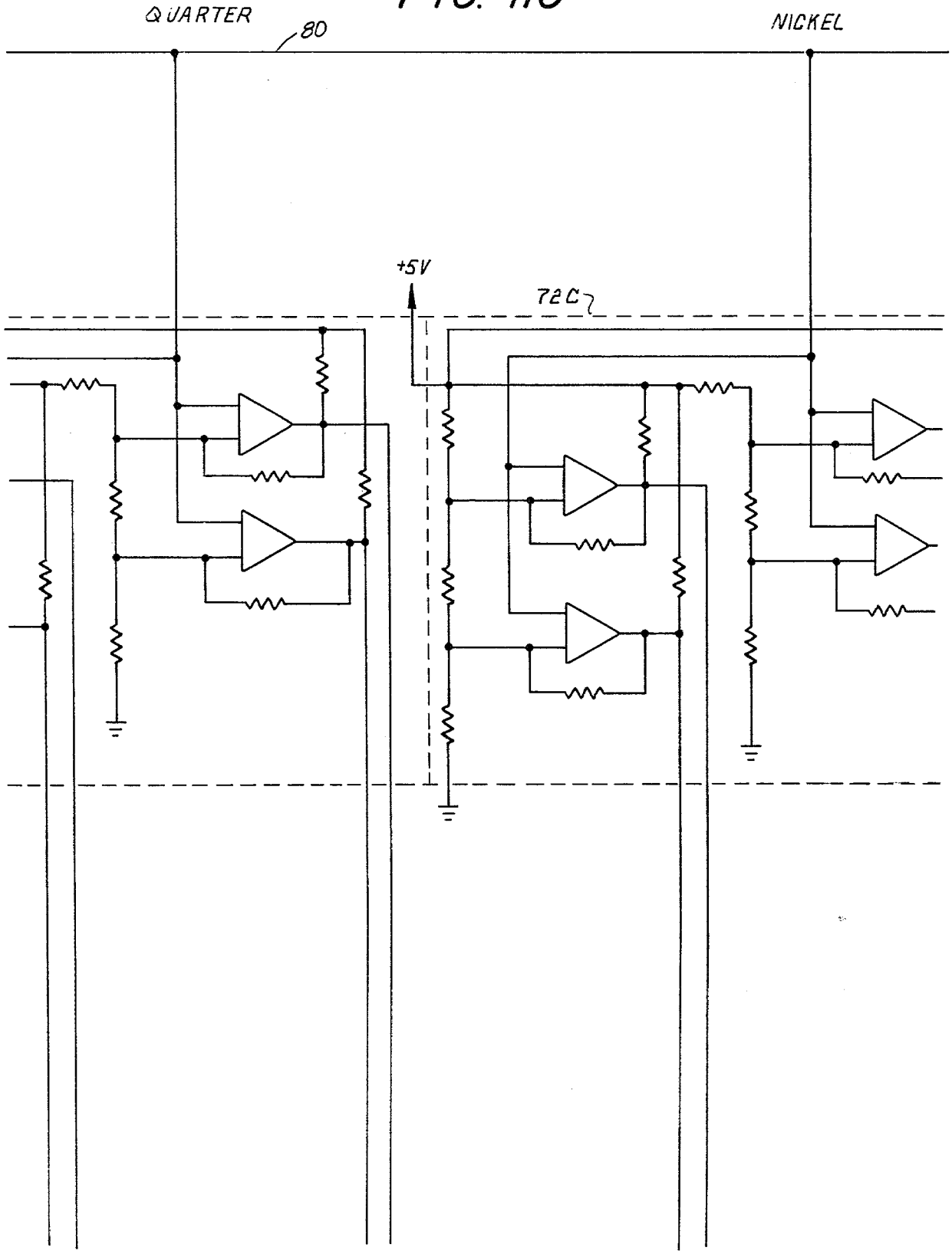
Figure 11D:
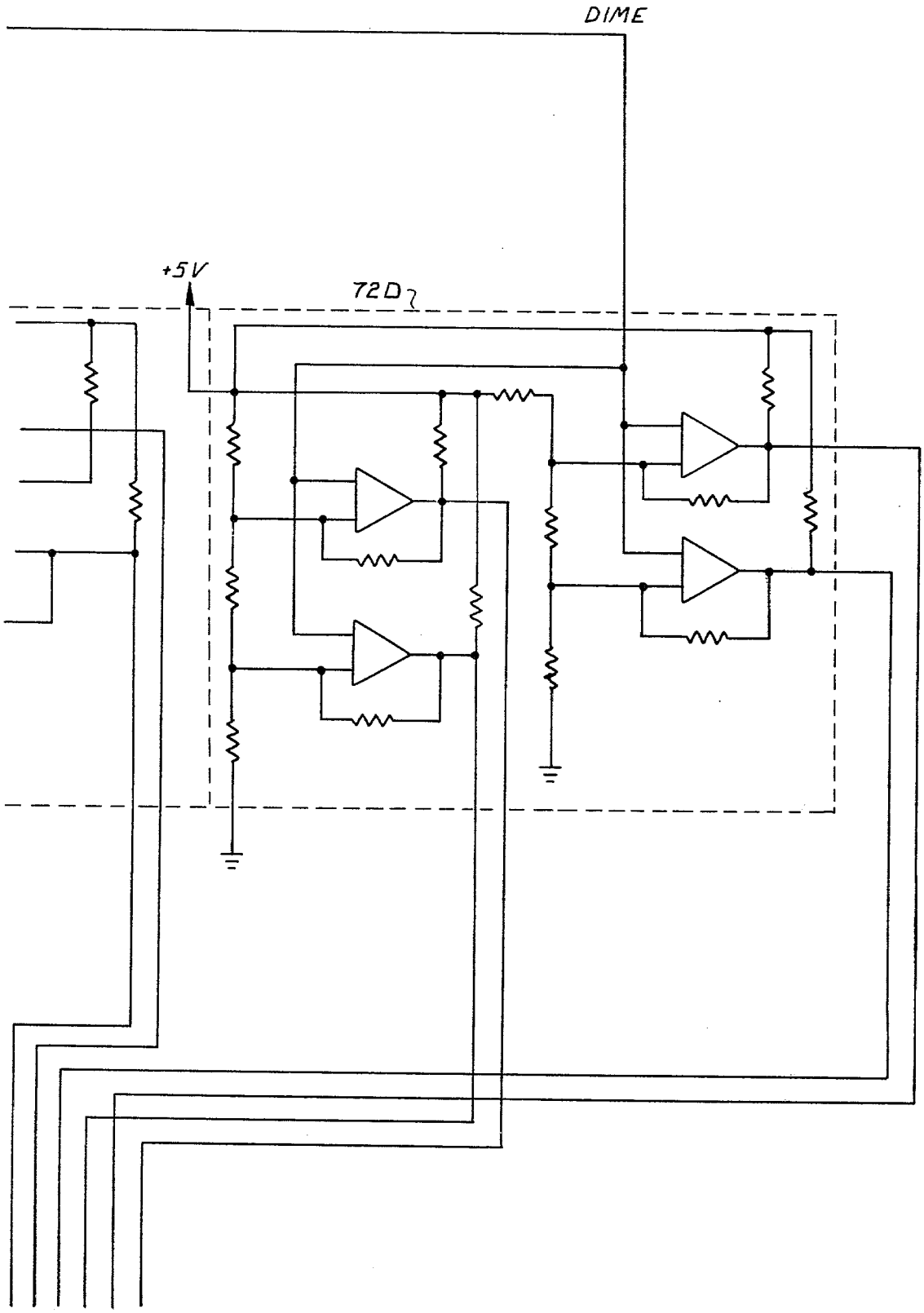
Figure 11E:
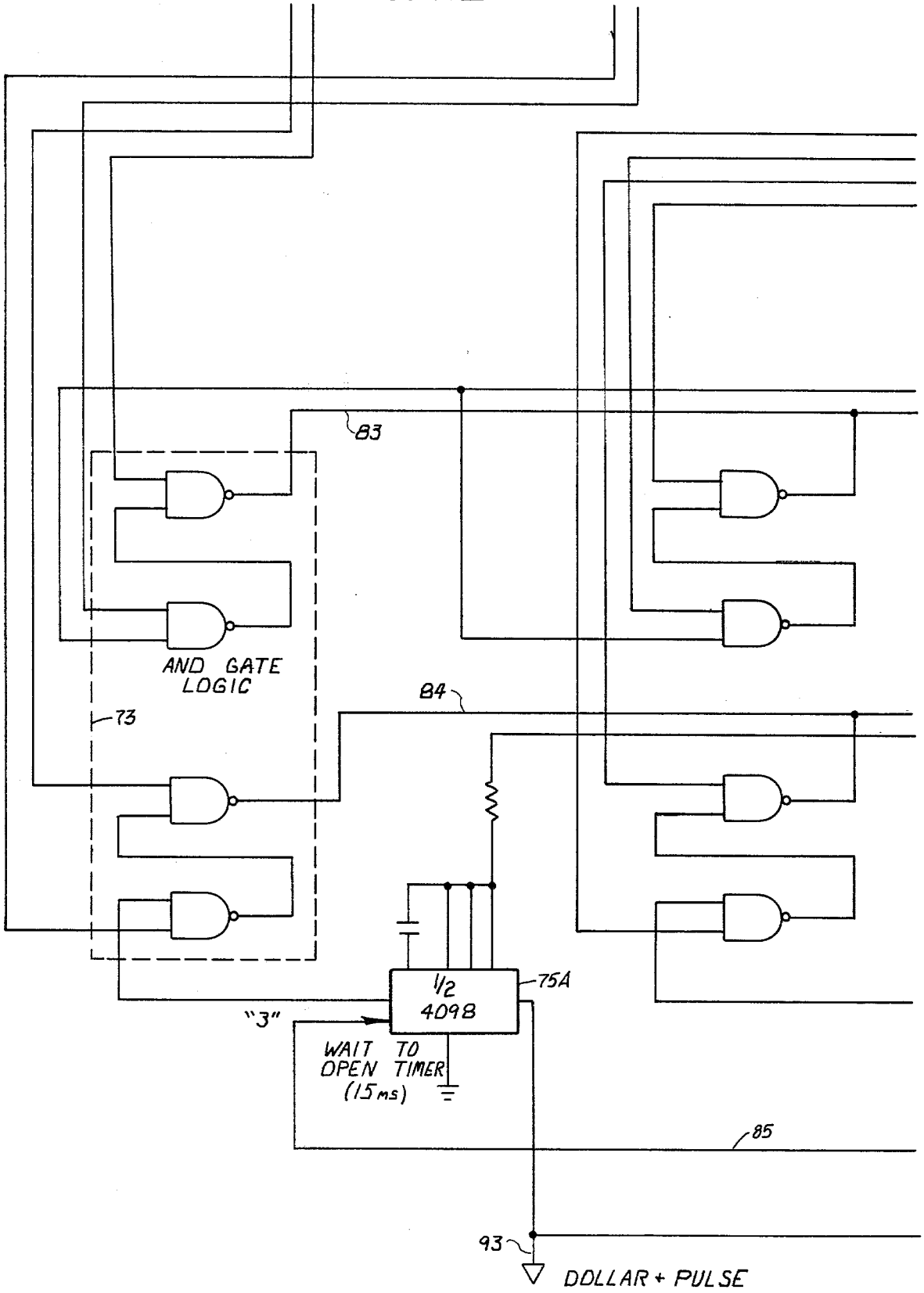
Figure 11F:
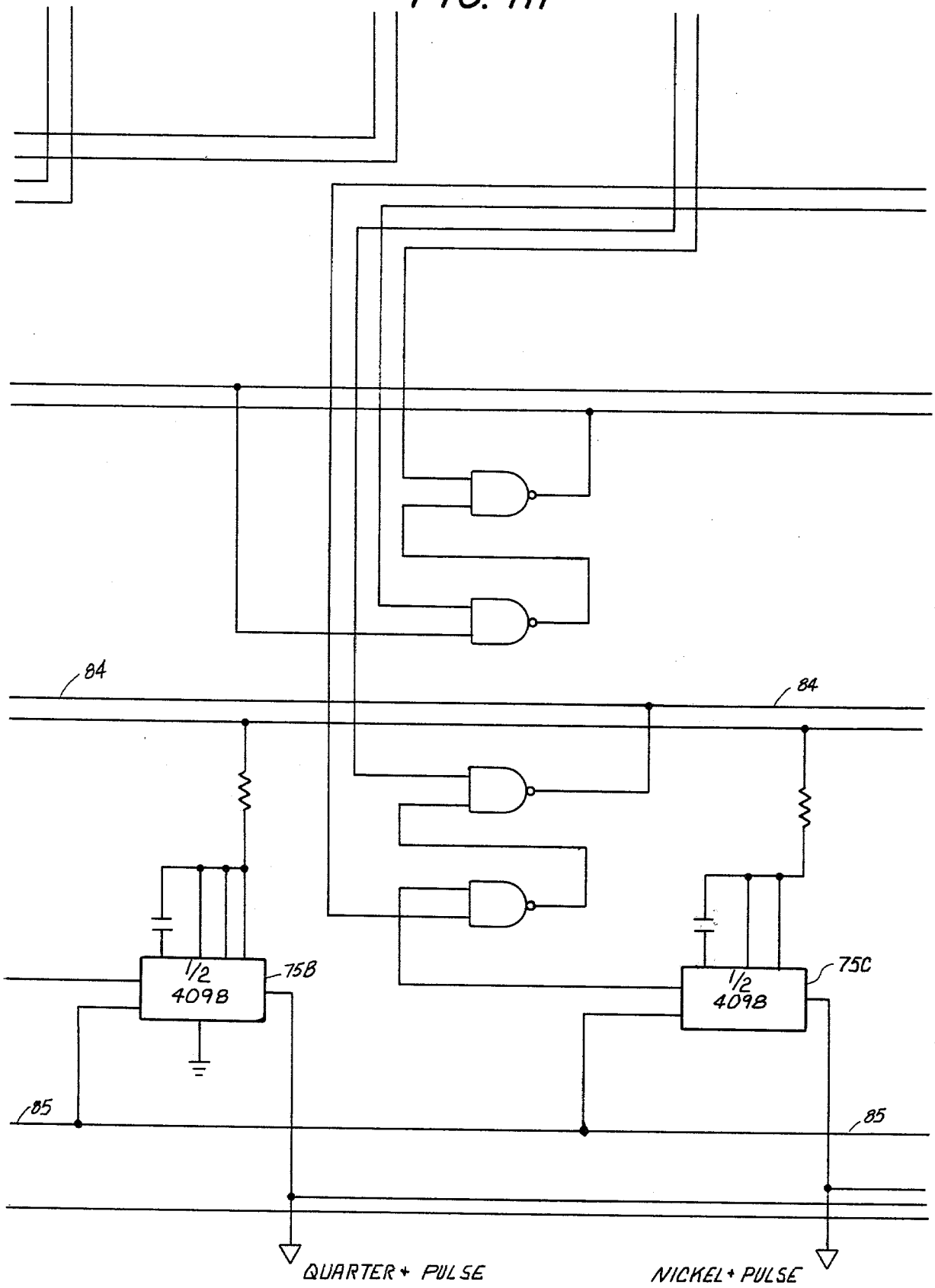
Figure 11G:
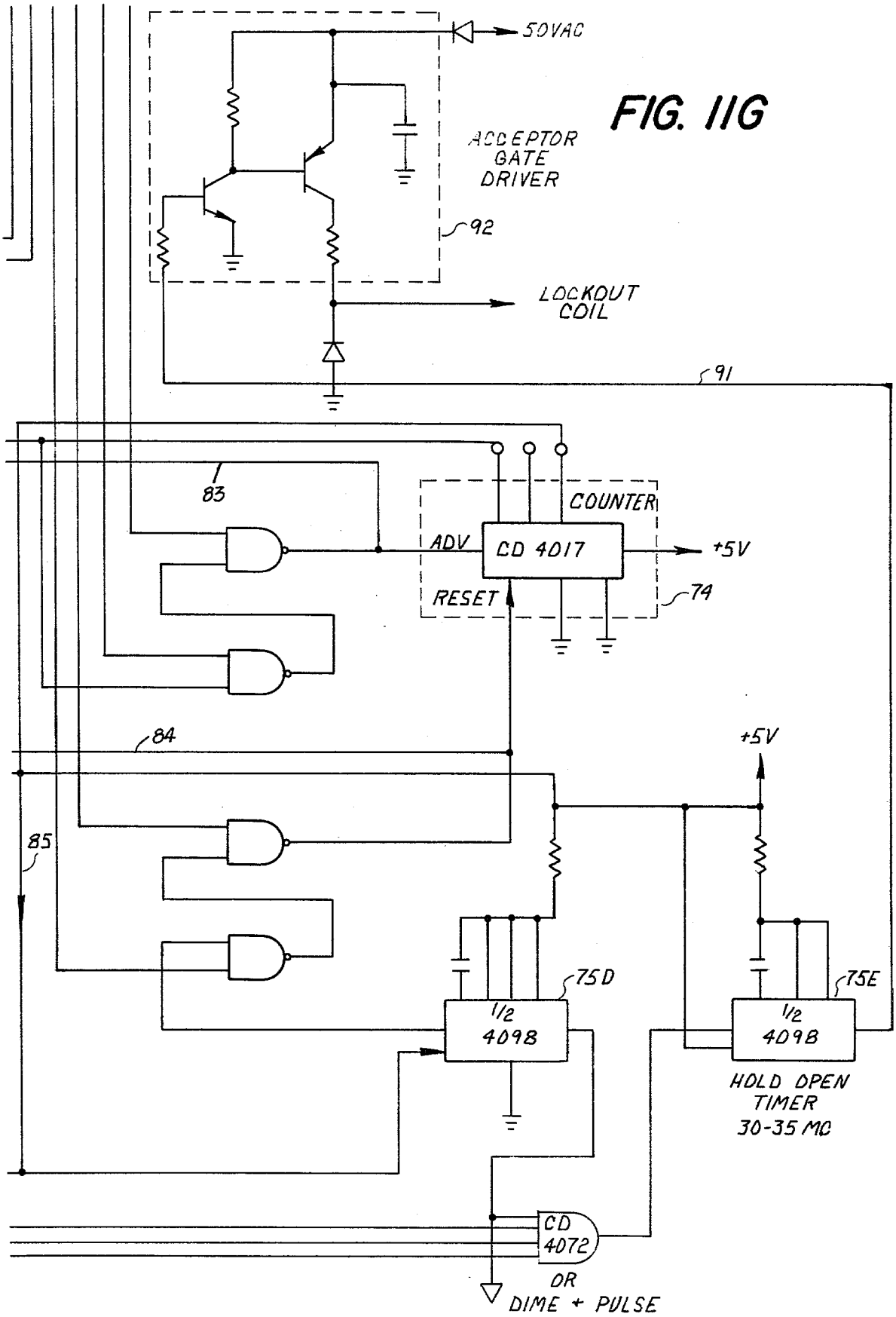

In the waveforms of FIGS. 10C and 10E, a maximum count of 2 is registered while in the remaining curves A, B, D and F the counter never advances beyond a count of 1.

The operative circuit which carries out this invention for multicoin operation may be seen in FIG. 11 which is made up of seven sheets arranged as shown in FIG. 4. As the system appears in FIG. 11, the oscillator 60 appears at the upper left of the drawing in FIG. 11A and is shown with its associated crystal 61. Connected through a pair of plug and jack combinations to the oscillator 60 is the resonant circuit 64 with its two coil sections 66A and 70A. The output of the oscillator amplifier 60 is coupled over lead 80 through capacitor 81 to detector 71. The detected output is introduced on to line 82 which feeds the detected characteristic of the coin to four (or more) similar circuits 72A, B, C and D, each including comparators selected to establish the required windows for each of the coins desired to be detected. The comparators, in this case four in number are four identical integrated circuits having four comparator circuits each to make the C-1 through C-4 comparisons required as described above. The integrated circuits are preferably type IC 339.

Figure 13:
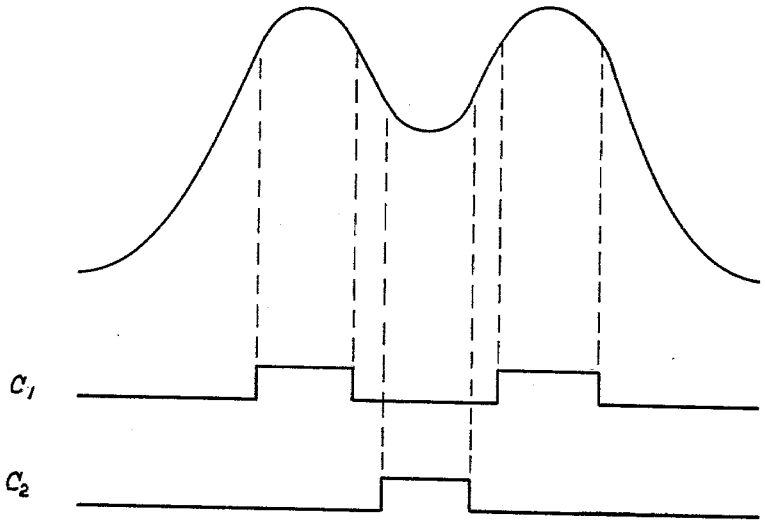
FIGS. 13 and 14 are further graphical and timing diagrams illustrating this invention.

The first comparator 72A is adjusted to establish the windows for a valid Susan B. Anthony dollar. Its four output level values when outputed are introduced into an NAND gate logic network 73 which responds to the C-1, C-3 sequence to advance the counter 74 via line 83. The same logic network responds to either a C-2 or a C-4 level to reset the counter 74 over lead 84. FIG. 13 illustrates the timing sequence of comparators C1 and C3.

Figure 14:
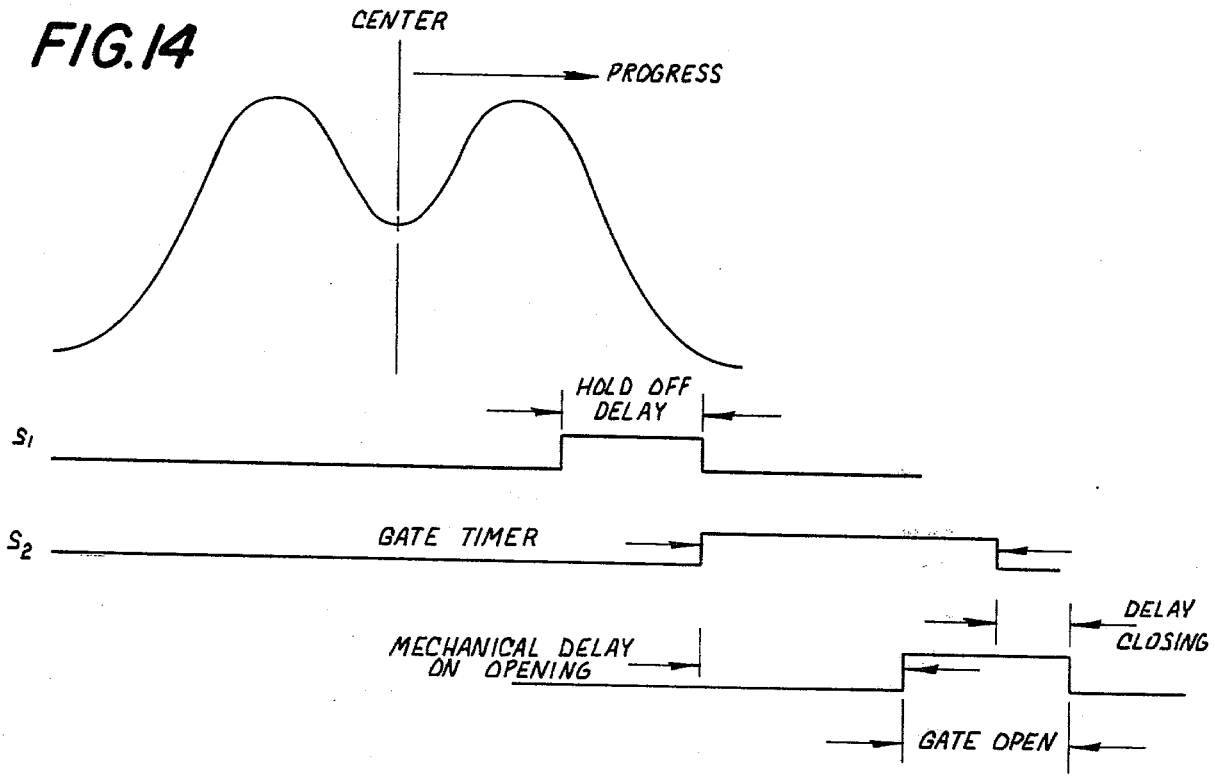

Whenever the counter 74 reaches a count of 3 it triggers four "wait to open" timers 75A,B,C, and D which have a delay such as 15 milliseconds, sufficient to allow the coin to complete its passage through the coin acceptor. This is illustrated in FIG. 14. The timers 75A-D are triggered over lead 85. These timers 75 are all connected via lead 86 and an OR gate 90 to a "hold open" timer 75E which in turn for a period such as 30 to 35 milliseconds applies an operating signal over lead 91 to the acceptance gate driver circuit 92 which in turn supplies solenoid operating power to the acceptance gate winding. Actuation of the circuit 92 under the conditions described above results in the Susan B. Anthony coin being accepted. An additional output on lead 93 is provided for use in counting the number of coins deposited for change making calculations or accounting purposes.

The comparators 72 are replicated as described above and the logic networks as well for each coin to be accepted. The operation of each of these replicated circuits is the same as described above for the Susan B. Anthony dollar. Given this replication, each coin is tested against the window combinations for each particular coin and if the criteria for any one is met, the acceptance gate will open.

Employing this invention, experimental apparatus exposed to a large number of valid coins plus an equally large number of foreign and non coin articles of the type commonly accepted by existing coin rejectors gave virtual 100% acceptance of valid coins and virtual 100% rejection of the invalid ones.

We have also found that the windows used for establishing acceptance or rejection of a coin may be narrowed or widened for the particular application. As an example, the window height for most applications is in the order of 5 volts where the maximum amplitude is in the order of 20 volts. We can narrow the window to in the order of 1 volt in order to accept coins which are virtually identical. This can, for example, be used to discriminate between uncirculated and circulated coins of the same denomination. A further application based upon this feature is the detection of coins having less than standard purity. We have found that coins having less than 1% deviation from established standards may be detected. This is particularly valuable in detecting bogus coins or bars of precious metals.

The foregoing detailed description is intended to disclose the best mode of carrying out the invention as known by the inventors at the time of filing of this application but is not to be in any respect a limitation on the scope of their invention. Rather, the invention shall be determined as defined by the following claims including their equivalents.

What is claimed is:

1. A coin acceptor comprising a frame assembly defining a package of size and shape interchangeable with electromechanical coin acceptors for coin actuated machines;

said frame assembly further defining a coin passage entrance and exit through said package;

a pair of spaced generally planar members for defining a continuous coin passage therebetween;

said generally planar members each mounting a series of conductive turns for establishing an electromagnetic field in the region of said coin passage;

said series of conductive turns including at least one generally straight length of turns having a straight length at least equal to the major transverse dimension of a coin to be accepted and separated from the remaining portion of said series of turns by a region free from turns;

means coupling electric current to said series of turns;

means for detecting changes in the current in said field as a function of the passage of coins through said passage;

logic means for detecting at least one maximum and one minimum level of current during the passage of a coin through said passage;

means for comparing the maximum and minimum current levels with a predetermined maximum and minimum value; and means for applying enabling input to said machine responsive to the output of said comparator means.

2. The combination in accordance with claim 1 wherein said planar members comprise a pair of printed circuit boards defining said coin passage therebetween and having said series of conductive turns on the opposite faces thereof.

3. The combination in accordance with claim 2 wherein said series of turns on said planar members are connected in series.

4. The combination in accordance with claim 1 including edge spacers between said planar members for defining said coin passage in a lateral direction to be restricted to the straight lengths of said conductive turns.

5. The combination in accordance with claim 1 wherein said apparatus defines a straight uninterrupted coin path through said coin acceptor.

6. A coin acceptor comprising an oscillator for establishing a oscillatory signal;

a resonant circuit for controlling the frequency of said oscillator, said resonant circuit comprising a pair of series of inductive turns and a capacitor;

dual means defining a coin passage therebetween;

said dual means mounting respective pairs of series of inductive turns to be electromagnetically coupled to said coin passage;

said series of inductive turns including linear portions coinciding with said coin passage;

means responsive to the change in electromagnetic coupling between said pairs of inductive turns due to a coin passage therebetween for registering a valid or invalid coin;

said responsive means comprising a series of amplitude comparators for comparing the amplitude of the current in said inductive circuit as a function of passage of a coin;

logic means coupled to said amplitude comparators for registering a valid coin responsive to a sequence of at least one predetermined maximum and sequential minimum amplitude being detected during coin passage.

7. The combination in accordance with claim 6 wherein said comparators comprise at least four comparators two for maximum amplitude level and two for minimum amplitude levels.

8. The combination in accordance with claim 7 wherein said maximum comparators include a first one for establishing a threshold value and the second for establishing a maximum level.

9. The combination in accordance with claim 8 wherein said logic means is responsive to said first comparator for registering an indicator of valid coin and responsive to said second maximum comparator for registering an invalid coin.

10. The combination in accordance with claim 9 including timing means responsive to the detection of said first maximum for enabling the detection of said first minimum whereby a valid coin will only be registered if a minimum of at least a predetermined level follows a maximum of a predetermined level.

11. The combination in accordance with claim 8 wherein said logic means is responsive to said first minimum comparator for registering an indication of a valid coin and responsive to said second minimum comparator for registering an invalid coin.

12. The combination in accordance with claim 7 wherein said logic means comprises a series of gates and a counter wherein said counter is advanced by pulses passing said gates corresponding to the maximum and minimum criteria.

13. The combination in accordance with claim 12 including means responsive to a predetermined count in said counter for registering a valid coin.

14. The combination in accordance with claim 12 including means responsive to exceeding said second maximum comparator or said second minimum comparator for resetting said counter.

15. The combination in accordance with claim 12 including means responsive to said counter reaching said predetermined count for registering a valid coin.

16. The combination in accordance with claim 15 including means for resetting said counter responsive for registering a valid coin.

17. The combination in accordance with claim 12 including logic means coupled to said first threshold comparator for registering a second passage of amplitude level past said threshold, said logic means coupled to said counter for advancing said counter upon the detection of the amplitude level reaching said first threshold for a second time.

18. The combination in accordance with claim 17 wherein said counter is responsive to a count of 3 for registering a valid coin.

19. The combination in accordance with claim 17 wherein said logic means is responsive to the exceeding of said second maximum comparator for resetting said comparator.

* * * * *